US008083004B2

(12) United States Patent
Knight, Jr.

(10) Patent No.: US 8,083,004 B2
(45) Date of Patent: Dec. 27, 2011

(54) RIPPER AUTODIG SYSTEM IMPLEMENTING MACHINE ACCELERATION CONTROL

(75) Inventor: Robert Paul Knight, Jr., Varna, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 11/730,083

(22) Filed: Mar. 29, 2007

(65) Prior Publication Data

US 2008/0243345 A1 Oct. 2, 2008

(51) Int. Cl.
*A01B 63/112* (2006.01)

(52) U.S. Cl. ..... 172/7; 172/699

(58) Field of Classification Search ..... 172/2, 3, 172/4, 7, 8, 699; 37/348; 56/10.2 G, 10.2 H, 56/10.2 R, DIG. 15; 701/50
See application file for complete search history.

(56) References Cited

U.S. PATENT DOCUMENTS

| | | | | |
|---|---|---|---|---|
| 4,031,964 | A | | 6/1977 | Takahashi et al. |
| 4,044,838 | A | | 8/1977 | Woolridge |
| 4,062,539 | A | | 12/1977 | Tetsuka et al. |
| 4,107,859 | A | | 8/1978 | Keith |
| 4,157,118 | A | | 6/1979 | Suganami et al. |
| 4,194,574 | A | | 3/1980 | Benson et al. |
| 4,244,123 | A | | 1/1981 | Lazure et al. |
| 4,344,499 | A | * | 8/1982 | van der Lely et al. ..... 180/197 |
| 4,518,044 | A | | 5/1985 | Wiegardt et al. |
| 4,630,685 | A | | 12/1986 | Huck, Jr. et al. |
| 4,818,107 | A | | 4/1989 | Ono et al. |
| 4,834,461 | A | | 5/1989 | Fidler et al. |
| 4,888,890 | A | | 12/1989 | Studebaker et al. |
| 4,900,093 | A | | 2/1990 | Krone et al. |
| 4,924,394 | A | * | 5/1990 | Uchida et al. ..... 701/75 |
| 4,991,659 | A | | 2/1991 | Stepe et al. |
| 5,100,229 | A | | 3/1992 | Lundberg et al. |
| 5,144,317 | A | | 9/1992 | Duddek et al. |
| 5,190,111 | A | | 3/1993 | Young et al. |
| 5,287,280 | A | | 2/1994 | Yamamoto et al. |
| 5,293,944 | A | | 3/1994 | Matsumoto |
| 5,297,649 | A | * | 3/1994 | Yamamoto et al. ..... 180/197 |
| 5,333,479 | A | * | 8/1994 | Yamamoto et al. ..... 172/3 |
| 5,375,663 | A | | 12/1994 | Teach |
| 5,438,771 | A | | 8/1995 | Sahm et al. |
| 5,461,803 | A | | 10/1995 | Rocke |
| 5,462,122 | A | | 10/1995 | Yamamoto et al. |

(Continued)

FOREIGN PATENT DOCUMENTS

| | | |
|---|---|---|
| AU | 745270 | 2/1999 |

(Continued)

*Primary Examiner* — Robert Pezzuto
*Assistant Examiner* — Jamie L McGowan
(74) *Attorney, Agent, or Firm* — Finnegan, Henderson, Farabow, Garrett & Dunner LLP

(57) ABSTRACT

A control system for a machine having a power source, a traction device, and a ripping tool is disclosed. The control system may have a slip sensor configured to generate at least one signal indicative of machine slippage, and at least one actuator operable to position the ripping tool. The control system may also have a controller in communication with the slip sensor, the at least one actuator, and the power source. The controller may be configured to receive at least one operator input indicative of an acceptable slip value, and determine actual machine slippage based on the at least one signal. The controller may also be configured to directly and separately regulate a speed of the machine and a position of the ripping tool during an excavation process based on the acceptable slip value and actual machine slippage.

22 Claims, 3 Drawing Sheets

U.S. PATENT DOCUMENTS

| | | | |
|---|---|---|---|
| 5,471,391 | A | 11/1995 | Gudat et al. |
| 5,485,885 | A | 1/1996 | Matsushita et al. |
| 5,493,494 | A | 2/1996 | Henderson |
| 5,515,927 | A | 5/1996 | Matsushita et al. |
| 5,535,830 | A | 7/1996 | Matsushita et al. |
| 5,551,518 | A | 9/1996 | Stratton |
| 5,551,524 | A | 9/1996 | Yamamoto et al. |
| 5,560,431 | A | 10/1996 | Stratton |
| 5,564,507 | A | 10/1996 | Matsushita et al. |
| 5,574,643 | A | 11/1996 | Yesel |
| 5,600,436 | A | 2/1997 | Gudat |
| 5,612,864 | A | 3/1997 | Henderson |
| 5,621,643 | A | 4/1997 | Nakagami et al. |
| 5,631,658 | A | 5/1997 | Gudat et al. |
| 5,646,844 | A | 7/1997 | Gudat et al. |
| 5,647,439 | A | 7/1997 | Burdick et al. |
| 5,659,985 | A | 8/1997 | Stump |
| 5,666,792 | A | 9/1997 | Mullins |
| 5,684,476 | A | 11/1997 | Anderson |
| 5,684,691 | A | 11/1997 | Orbach et al. |
| 5,685,377 | A | 11/1997 | Arstein et al. |
| 5,694,317 | A | 12/1997 | Nakagami et al. |
| 5,699,248 | A | 12/1997 | Nakagami et al. |
| 5,721,679 | A | 2/1998 | Monson |
| 5,735,352 | A | 4/1998 | Henderson et al. |
| 5,755,291 | A | 5/1998 | Orbach et al. |
| 5,764,511 | A | 6/1998 | Henderson |
| 5,771,978 | A | 6/1998 | Davidson et al. |
| 5,819,190 | A | 10/1998 | Nakagami et al. |
| 5,835,874 | A | 11/1998 | Hirata et al. |
| 5,848,368 | A | 12/1998 | Allen et al. |
| 5,875,854 | A | 3/1999 | Yamamoto et al. |
| 5,911,279 | A | 6/1999 | Whitener |
| 5,911,769 | A | 6/1999 | Orbach et al. |
| 5,974,352 | A | 10/1999 | Shull |
| 5,987,371 | A | 11/1999 | Bailey et al. |
| 6,125,561 | A | 10/2000 | Shull |
| 6,216,072 | B1 | 4/2001 | Boe et al. |
| 6,317,676 | B1 | 11/2001 | Gengler et al. |
| 6,336,068 | B1 | 1/2002 | Lawson et al. |
| 6,631,320 | B1 | 10/2003 | Holt et al. |
| 6,666,279 | B2 * | 12/2003 | Scarlett et al. ..... 172/1 |
| 6,718,246 | B2 | 4/2004 | Griffith et al. |
| 6,845,311 | B1 | 1/2005 | Stratton et al. |
| 7,051,498 | B2 | 5/2006 | Modzik et al. |
| 7,519,462 | B2 | 4/2009 | Brown et al. |
| 2003/0121674 | A1 * | 7/2003 | Scarlett et al. ..... 172/2 |
| 2004/0249543 | A1 * | 12/2004 | Kilworth et al. ..... 701/54 |
| 2007/0044980 | A1 | 3/2007 | Stratton et al. |
| 2007/0073465 | A1 | 3/2007 | Brown et al. |
| 2007/0131438 | A1 | 6/2007 | Brandt et al. |
| 2008/0027610 | A1 | 1/2008 | Shull |

FOREIGN PATENT DOCUMENTS

| | | | | |
|---|---|---|---|---|
| DE | 195 10 376 | A1 | | 9/1995 |
| EP | 0 443 026 | A1 | | 8/1991 |
| GB | 2 228 507 | A | | 8/1990 |
| JP | 62-268433 | | | 11/1987 |
| JP | 63004131 | A | * | 1/1988 |
| JP | 03036335 | | | 2/1991 |
| JP | 05106239 | A | | 4/1993 |
| WO | WO-97/01105 | | | 1/1997 |

* cited by examiner

RIPPER AUTODIG SYSTEM IMPLEMENTING MACHINE ACCELERATION CONTROL

TECHNICAL FIELD

The present disclosure relates to an autodig system and, more particularly, to a ripper autodig system that implements machine acceleration control.

BACKGROUND

Mobile excavation machines, such as, for example, dozers, agricultural tractors, and scrapers, often include one or more material engaging implements utilized to cultivate, dig, rip or otherwise disturb a ground surface. The ground surface can include non-homogenous loose soil or compacted material that can be easy or difficult for the machine to process. As the machines traverse a site that has changing terrain and/or varying ground surface conditions, the magnitude of resistance applied to the implements by the material also varies, and higher amounts of resistance can lead to machine slip. Generally, slip represents the error between driven speed and actual machine travel speed. In order to ensure that a maximum productivity of the machine is attained without damaging the machine (i.e. a maximum amount of power is transmitted to the material with minimal slip), the operator of the machine must continuously alter settings of the machine and implements to accommodate the changing terrain and ground surface conditions. This continuous altering can be tiring for even a skilled operator and difficult, if not impossible, for a novice operator to achieve optimally.

One way to efficiently accommodate changes in terrain and surface composition may include autonomously controlling the machine during portions of the excavation process. One such autonomously controlled machine is described in U.S. Pat. No. 4,062,539 ("the '539 patent") issued to Tetsuka et al. on Dec. 13, 1977. The '539 patent discloses a control system provided with a ripper detector, which detects when a ripping tool is operated in a piercing mode or a digging mode. In the piercing mode, the angle of a ripping tool's shank is automatically adjusted to a preset piercing angle, while in the digging mode, the shank angle is adjusted to a preset digging angle. Limit switches for detecting upper and lower limit positions of the ripping tool's shank are provided for automatically raising and lowering the tool between these limits, while adjusting the shank angle. Further, an overload detector is provided for automatically raising the shank when its load exceeds a predetermined load, and lowering the shank when the load decreases below it.

Although the control system of the '539 patent may improve machine efficiency and reduce operator fatigue by automating some of the functions normally controlled by the operator, it may be limited. Specifically, the control system may consider too few inputs when raising and lowering the shank. That is, because the control system only considers load, as measured at the shank, there may be situations when the load on the shank is below the predetermined load and, yet, the shank penetration is too deep for maximum productivity such as when the machine is on a loose or viscous surface and slipping. In addition, because the control system only controls shank operation, the operator may still be required to expend time and energy controlling machine functions such as speed and acceleration. Further, the control system may be applicable to only a single ripper configuration.

The present disclosure is directed to overcoming one or more of the shortcomings set forth above.

SUMMARY OF THE INVENTION

In one aspect, the present disclosure is directed to a control system for a machine having a power source, a traction device, and a ripping tool. The control system may include a slip sensor configured to generate at least one signal indicative of machine slippage, and at least one actuator operable to position the ripping tool. The control system may also include a controller in communication with the slip sensor, the at least one actuator, and the power source. The controller may be configured to receive at least one operator input indicative of an acceptable slip value, and determine actual machine slippage based on the at least one signal. The controller may also be configured to directly and separately regulate a speed of the machine and a position of the ripping tool during an excavation process based on the acceptable slip value and actual machine slippage.

In another aspect, the present disclosure is directed to a method of autonomously controlling a ripping tool of a mobile machine. The method may include receiving an acceptable machine slip value, and determining actual machine slippage. The method may also include directly and separately regulating a speed of the mobile machine and a position of the ripping tool during an excavation process based on the acceptable machine slip value and actual machine slippage.

DETAILED DESCRIPTION

Figure 1:
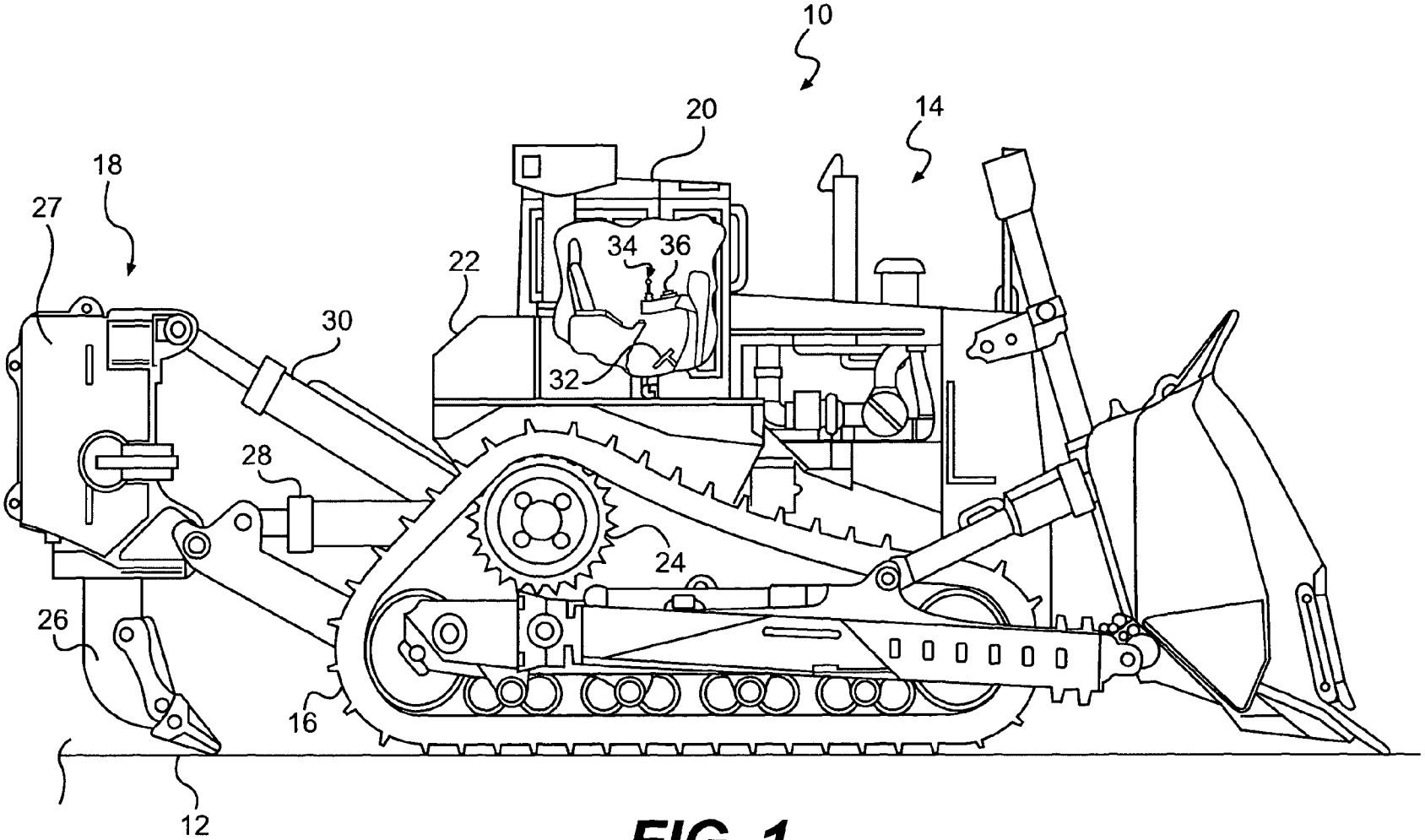
FIG. 1 is a diagrammatic illustration of an exemplary disclosed excavation machine.

FIG. 1 illustrates an exemplary machine 10. Machine 10 may include any mobile machine that performs some type of operation associated with an industry, such as, for example, mining, construction, farming, or any other industry known in the art. For example, machine 10 may be an earth moving machine such as a dozer, a loader, a backhoe, an excavator, a motor grader, or any other earth moving machine. Machine 10 may traverse a work site to manipulate material beneath a work surface 12, e.g. transport, cultivate, dig, rip, and/or perform any other operation known in the art. Machine 10 may include a power source 14 configured to produce mechanical power, a traction device 16, at least one ripper 18, and an operator station 20 to house operator controls. It is contemplated that machine 10 may additionally include a frame 22 configured to support one or more components of machine 10.

Power source 14 may be any type of internal combustion engine such as, for example, a diesel engine, a gasoline engine, or a gaseous fuel-powered engine. Further, power source 14 may be a non-engine type of power producing device such as, for example, a fuel cell, a battery, a motor, or another type of power source known in the art. Power source 14 may produce a variable power output directed to ripper 18 and traction device 16 in response to one or more inputs.

Traction device 16 may include tracks located on each side of machine 10 (only one side shown) and operatively driven by one or more sprockets 24. Sprockets 24 may be operatively connected to power source 14 to receive power therefrom and drive traction device 16. Movement of traction device 16 may propel machine 10 with respect to work surface 12. It is contemplated that traction device 16 may additionally or alternately include wheels, belts, or other traction devices, which may or may not be steerable. It is also contemplated that traction device 16 may be hydraulically actuated, mechanically actuated, electronically actuated, or actuated in any other suitable manner.

Ripper 18 may be configured to lift, lower, and tilt relative to frame 22. For example, ripper 18 may include a shank 26 held in place by a mounting member 27. Shank 26 may penetrate work surface 12 to disturb or disrupt (i.e. rip) the material below work surface 12, and may move relative to mounting member 27. More specifically, shank 26 may have several configurations relative to mounting member 27. For example, shank 26 may be moved higher, lower, away from, and toward frame 22. Mounting member 27 may be connected to frame 22 via a linkage system with at least one implement actuator forming a member in the linkage system, and/or in any other suitable manner. For example, a first hydraulic actuator 28 may be connected to lift and lower ripper 18, and a second hydraulic actuator 30 may be connected to tilt ripper 18. It is contemplated that ripper 18 may alternatively include a plow, a tine, a cultivator, and/or any other task-performing device known in the art.

The movement of ripper 18 may correspond to a plurality of predetermined locations and/or orientations (i.e. angle settings of shank 26). For example, shank 26 may have a discrete penetration angle and a discrete dig angle that can change based on a material composition of the work surface, a size or capacity of machine 10, and/or the configuration of shank 26 relative to mounting member 27. In one example, the penetration angle of shank 26 may be substantially vertical relative to work surface 12 for efficient penetration of work surface 12. In order to maintain this vertical angle for each of the available shank configurations, the implement actuators of mounting member 27 may need to be adjusted based on the current shank configuration. Further, the dig angle of shank 26 may correspond to a forward tilt of shank 26 to facilitate efficient digging, while keeping shank 26 from digging under machine 10 and forcing material against an underbelly of machine 10. In order to maintain shank 26 at the correct digging position relative to the underbelly of machine 10, the implement actuators of mounting member 27 may again need to be adjusted based on the current shank configuration.

In an exemplary digging operation, an operator of machine 10 may set the configuration of shank 26. For example, the operator may manually loosen bolts fastening shank 26 to mounting member 27 in a first configuration, move shank 26 to a discrete location on mounting member 27, and tighten the bolts to retain shank 26 in place. In another example, shank 26 may be moveable by a motor, pulley system, or a hydraulic actuator to mechanically slide from the first configuration to the second configuration. It is contemplated that this sliding mechanism may be controlled electrically or mechanically by the operator and/or a controller. That is, the operator may set the configuration of shank 26 by manipulating a switch, a joystick, a button, or any other interface known in the art.

The operator may then control the implement actuators of mounting member 27 to set shank 26 to a predetermined penetration angle associated with the current configuration of shank 26. That is, the operator may control the implement actuators of mounting member 27 to orient shank 26 at a vertical angle relative to work surface 12 prior to penetration. The operator may then control the implement actuators to lower shank 26 and penetrate work surface 12. Once shank 26 has penetrated work surface 12, the operator may control the implement actuators of mounting member 27 to set shank 26 to a predetermined dig angle for the current configuration of shank 26. That is, the operator may again control the implement actuators to set shank 26 to a dig angle that does not place shank 26 under machine 10, yet facilitates efficient digging. It is contemplated that all or some of the above-described digging process may be managed automatically, as will be described further below.

On some terrains, the penetration of shank 26 into work surface 12 may cause machine 10 to slip. Slip may be exemplified by a difference between an actual ground speed of machine 10 and a speed of traction device 16. That is, slip is determined to be occurring when the actual ground speed of machine 10 is less than the speed of traction device 16. The magnitude of slip may be influenced by characteristics of the material below work surface 12, the cut depth or angle of shank 26, and a speed or torque of traction device 16. For example, when machine 10 is engaged in a ripping operation, the material below work surface 12 may resist the movement of shank 26 through it, thus resisting the forward movement of machine 10. The amount of resistance applied by the material may increase with an increasing cut depth or angle of shank 26, and an increasing speed of traction device 16. As resistance to shank movement increases, a torque of traction device 16 may also increase. Eventually, the torque imparted by traction device 16 may exceed a capacity of work surface 12 to resist the torque, and slip may occur.

The magnitude of slip may be represented by a value. For example, a unitless expression of slip error (Se) may be calculated by relating a speed of traction device 16 (St) with respect to machine 10 and the speed of machine 10 (Sm) with respect to work surface 12, according to the mathematical formula: $Se=1-(Sm/St)$. Thus, zero slip (e.g. $St=Sm$) may correspond to a slip error value of 0, and complete slip (e.g. $Sm=0$ when $St>0$) may correspond to a slip error value of 1. It is contemplated that the expression of slip error may alternatively be represented as a fraction of machine or driven speed, a percentage, and/or any other value, if desired. It is further contemplated that zero slip may or may not be desirable and that it may be beneficial to monitor and allow slip within a predetermined range.

Hydraulic actuators 28, 30 may each include a piston-cylinder arrangement, a hydraulic motor, and/or another known hydraulic device having one or more fluid chambers therein. In a piston-cylinder arrangement, pressurized fluid may be selectively supplied to and drained from one or more chambers thereof to affect linear movement of the actuator, as is known in the art. In a hydraulic motor arrangement, pressurized fluid may be selectively supplied to and drained from chambers on either side of an impeller to affect rotary motion of hydraulic actuators 28, 30. The movement of hydraulic actuator 28 may assist in moving ripper 18 with respect to frame 22 and work surface 12, particularly down toward and up away from work surface 12. It is contemplated that an extension of hydraulic actuator 28 may correlate to a position of ripper 18 with respect to work surface 12. Similarly, the movement of hydraulic actuator 30 may assist in orienting ripper 18 with respect to frame 22 and work surface 12, particularly decreasing or increasing the angle of ripper 18 relative to work surface 12. It is contemplated that an extension of hydraulic actuator 30 may correlate to an orientation of ripper 18 with respect to work surface 12.

Operator station 20 may provide a control interface for an operator of machine 10. For example, operator station 20 may include a deceleration pedal 32, a ripper control 34, and an autodig switch 36. Although not shown, it is contemplated that operator station 20 may additionally include other controls such as, for example, a machine direction control, an acceleration pedal, or any other control device known in the art.

Deceleration pedal 32 may determine, at least in part, the amount of mechanical power delivered to traction device 16. That is, machine 10 may be operable in a "high idle" mode, during which a maximum amount of mechanical power is delivered to move traction device 16. This amount of mechanical power may be decreased from the maximum by manipulation of deceleration pedal 32. That is, deceleration pedal 32 may be operatively connected to power source 14 to affect the operation of power source 14 by reducing an amount of fuel delivered to power source 14, changing a timing of fuel injections into power source 14, and/or reducing an amount of air delivered to power source 14.

Deceleration pedal 32 may be continuously moveable between a first position and a second position such that an operator may depress deceleration pedal 32 from the first position to the second position. The degree of movement of deceleration pedal 32 toward the second position may proportionally decrease the amount of power delivered to drive traction device 16. For example, the maximum amount of power may be delivered to drive traction device 16 when deceleration pedal 32 is in the first position (i.e. fully extended), a minimum amount of power may be delivered to drive traction device 16 when deceleration pedal 32 is in the second position (i.e. fully depressed), and approximately 50% of the maximum amount of power may be delivered to drive traction device 16 when deceleration pedal 32 is in a position substantially halfway between the first and second positions. It is contemplated that machine 10 may alternatively be operable in a "low idle" mode, with acceleration being controlled by the acceleration pedal of operator station 20, or in any other mode known in the art.

An operator of machine 10 may utilize deceleration pedal 32 to reduce or eliminate slip of machine 10. For example, when machine 10 slips, as described above, the operator may depress deceleration pedal 32 to reduce the power output of power source 14, thus reducing the torque and/or speed of traction device 16. A reduction in the torque at traction device 16 may result in a reduction or elimination of slip.

Ripper control 34 may allow an operator of machine 10 to manipulate ripper 18. More specifically, ripper control 34 may control an amount or a pressure of fluid supplied to and drained from hydraulic actuators 28, 30. Thus, ripper control 34 may allow the operator to set a height of shank 26 above or below work surface and an angle of shank 26 relative to work surface 12. Ripper control 34 may allow the operator to move shank 26 from a position above work surface 12 down to penetrate work surface 12, and to set a depth of cut below work surface 12 so that shank 26 may disturb or disrupt the material below work surface 12 during a ripping operation. Ripper control 34 may also allow the operator to change the angle of shank 26 relative to work surface 12 while shank 26 is above or below work surface 12. For example, the operator may manipulate ripper control 34 to set shank 26 to an optimal penetration angle before lowering shank 26 to penetrate work surface 12. The operator may further manipulate ripper control 34 to set shank 26 to an optimal dig angle once shank 26 has penetrated work surface 12 to a desired depth. Ripper control 34 may embody, for example, a joystick. It is contemplated that ripper control 34 may embody any other appropriate control apparatus known in the art, and that ripper control 34 may alternatively embody separate control apparatuses for determining the height and angle of shank 26, respectively.

An operator of machine 10 may utilize ripper control 34 to reduce or eliminate slip of machine 10. For example, when machine 10 slips, the operator may manipulate ripper control 34 to reduce a penetration depth of shank 26 below work surface 12. By reducing the depth of shank 26, the amount of resistance to the movement of machine 10 caused by the digging of shank 26 may also be reduced. A reduction in this movement resistance may minimize or even eliminate slip of machine 10. Alternatively or additionally, an operator may change the penetration or dig angle of shank 26 to similarly minimize resistance and slip.

A minimum amount of slip may contribute to a maximum digging productivity of machine 10. For example, digging productivity of machine 10 may be represented by a ratio of an amount of material disturbed by shank 26 to the amount of time taken to disturb the material. Thus, a maximum digging productivity may correspond to a maximum amount of material disturbed in a minimum amount of time. More specifically, digging productivity may be maximized by maximizing the depth of shank 26 below work surface 12, maximizing a ground speed of machine 10, and minimizing slip of machine 10. It may be difficult for an operator to achieve optimal productivity. Therefore, an autonomous dig function may be provided for control of ripper 18.

Autodig switch 36 may allow the operator of machine 10 to signal a desired beginning and end of the autonomous dig function ("autodig"). For example, the operator may move autodig switch 36 to an on position to signal that an autodig operation should begin, and to an off position to signal that the autodig operation should end. Autodig switch 36 may be communicatively coupled with a control system 38 (shown in FIG. 2) that controls the autodig operation. Thus, autodig switch 36 may deliver a signal to control system 38 to indicate the beginning or end of an autodig operation. It is contemplated that control system 38 may alternatively check the position of autodig switch 36 to determine whether an autodig operation should start or stop. It is also contemplated that autodig switch 36 may alternatively embody an on/off button, wherein each press of the button toggles an autodig operation on and off. It is further contemplated that the operator may additionally or alternatively signal the end of an autodig operation by manually manipulating deceleration pedal 32 or ripper control 34, if desired.

Figure 2:
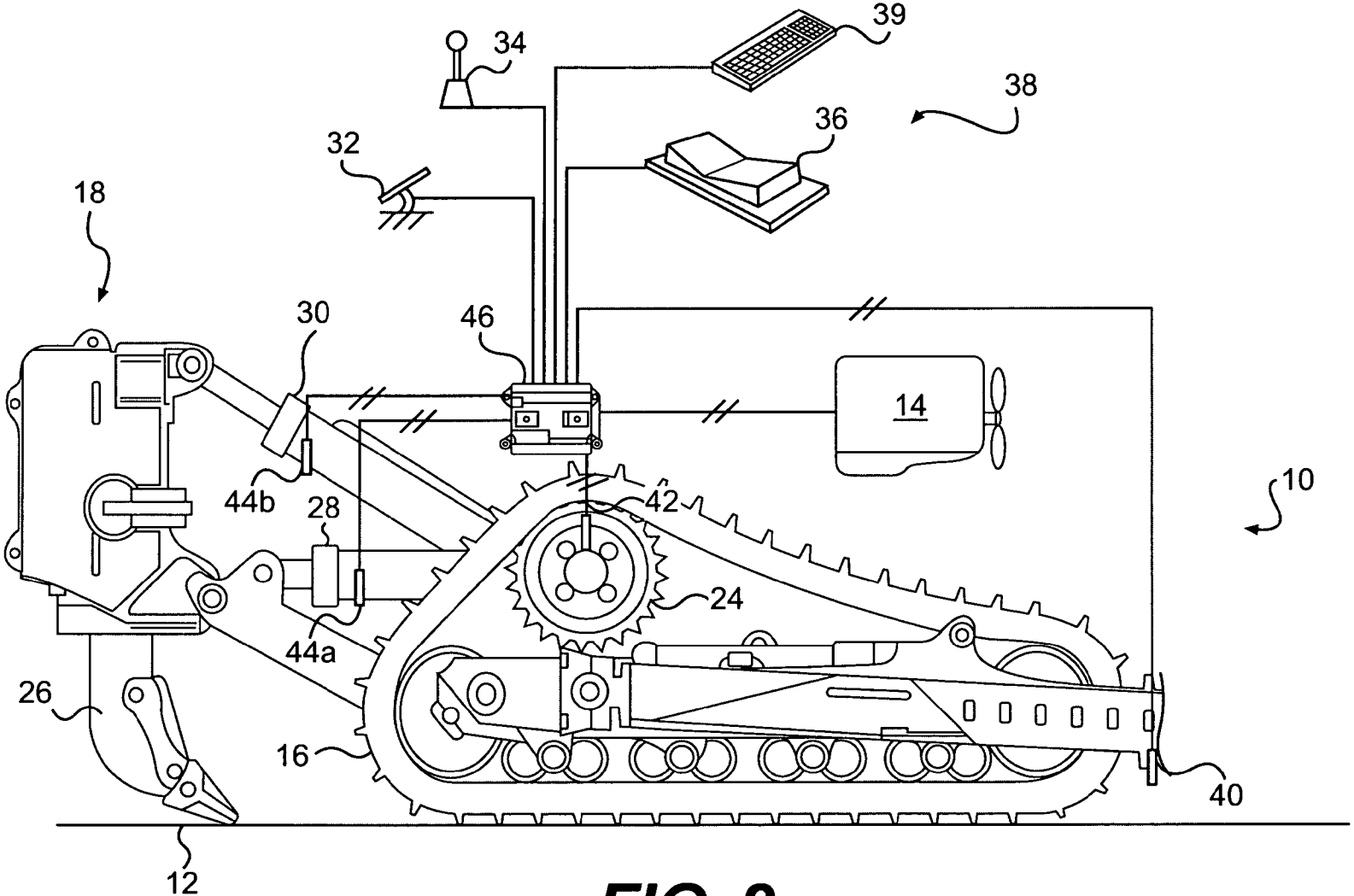
FIG. 2 is a diagrammatic and schematic illustration of an exemplary disclosed control system for use with the machine of FIG. 1.

FIG. 2 illustrates control system 38 as having components that cooperate to move ripper 18 during an autodig operation. For example, control system 38 may include a user interface 39, a first sensor 40 to measure true ground speed, a second sensor 42 to measure the speed of traction device 16, a third sensor 44 to monitor the positions of hydraulic actuators 28, 30, and a controller 46. User interface 39 may allow an operator to input values relevant to an autodig operation, such as, for example, an operation of shank 26, an upper threshold for machine slip, a lower threshold for machine slip, a desired penetration angle of shank 26, and a desired dig angle of shank 26. It is contemplated that these input values may be delivered to control system 38 when the operator signals the beginning of an autodig operation, before the operator signals the beginning of the autodig operation, or substantially immediately after the operator signals the beginning of the autodig operation. It is also contemplated that optimal penetration and dig angle values may be predetermined or calculated automatically by controller 46 based on, for example, the configuration of shank 26 relative to mounting member 27.

Sensors 40, 42, 44 may each include conventional hardware to establish a signal as a function of a sensed physical parameter. Sensor 40 may be located to sense the speed of machine 10 with respect to work surface 12. For example, sensor 40 may be disposed adjacent work surface 12, and may generate a signal indicative of a speed of machine 10 relative to work surface 12. Sensor 40 may embody any type of motion or speed sensing sensor such as, for example, a global positioning sensor, an infrared sensor, or a radar sensor. For example, sensor 40 may transmit a radio signal with a given wavelength and frequency toward work surface 12. The radio signal may bounce off of work surface 12 back to sensor 40 with a changed wavelength and/or frequency according to the Doppler effect. Sensor 40 may then use the difference between the original wavelength and frequency and the changed wavelength and frequency to calculate the speed of machine 10. It is contemplated that sensor 40 may selectively include a plurality of sensors establishing a plurality of signals, and that the plurality of signals may be combinable into a common signal, if desired.

Sensor 42 may sense the speed of traction device 16 with respect to machine 10. For example, sensor 42 may be disposed adjacent a driven component associated with traction device 16, e.g. sprockets 24. Sensor 42 may operate similarly to sensor 40. That is, sensor 42 may generate a signal indicative of a speed of the driven component, and may embody any type of motion or speed sensing sensor such as, for example, a hall sensor, or a rotation sensor. For example, sensor 42 may be sensitive to variations in a given magnetic field generated by sensor 42 or by another component near sensor 42. As sprockets 24 rotate to drive traction device 16, magnetic elements embedded within sprockets 24 may cause a variation in a magnetic field. Sensor 42 may then use the frequency of the variations to calculate the speed of the driven component. It is contemplated that sensor 42 may selectively include a plurality of sensors establishing a plurality of signals, and that the plurality of signals may be combinable into a common signal, if desired.

Sensor 44 may sense an extension of one or more chambers of hydraulic actuators 28, 30. As indicated in FIG. 2, sensor 44 may embody two individual sensors 44*a*, 44*b* associated with hydraulic actuator 28 and hydraulic actuator 30, respectively. Sensor 44*a* may be disposed adjacent to and/or within hydraulic actuator 28 to generate a signal indicative of an extension of hydraulic actuator 28. It is contemplated that the signal generated by sensor 44*a* may represent values proportional to the lift of ripper 18. It is also contemplated that sensor 44*a* may embody any type of sensor known in the art, such as, for example, a position sensor. That is, sensor 44*a* may generate a signal indicative of a length distance within a chamber of hydraulic actuator 28. It is contemplated that sensor 44*a* may selectively include a plurality of sensors each establishing a plurality of signals, and that the plurality of signals may be combinable into a common signal.

Sensor 44*b* may operate similarly to sensor 44*a*. More specifically, sensor 44*b* may be disposed adjacent to and/or within hydraulic actuator 30 to generate a signal indicative of an extension of hydraulic actuator 30. It is contemplated that the signal generated by sensor 44*b* may represent values proportional to the tilt angle of ripper 18. It is also contemplated that sensor 44*b* may embody any type of sensor known in the art, such as, for example, a position sensor. That is, sensor 44*b* may generate a signal indicative of a length distance within a chamber of hydraulic actuator 30. It is contemplated that sensor 44*b* may selectively include a plurality of sensors each establishing a plurality of signals, and that the plurality of signals may be combinable into a common signal.

Controller 46 may receive the signals generated by sensors 40, 42, 44 to assist in controlling operation of machine 10 during an autodig operation. That is, controller 46 may be communicatively coupled with sensors 40, 42, 44, autodig switch 36, deceleration pedal 32, ripper control 34, hydraulic actuators 28, 30, user interface 39, and any other component of machine 10 that may be used in controlling operation of machine 10 during an autodig operation.

Controller 46 may embody a single microprocessor or multiple microprocessors that include a means for controlling machine 10 during an autodig operation. For example, controller 46 may include a memory, a secondary storage device, and a processor, such as a central processing unit or any other means for controlling machine 10 during an autodig operation. Numerous commercially available microprocessors can be configured to perform the functions of controller 46. It should be appreciated that controller 46 could readily embody a general power source microprocessor capable of controlling numerous power source functions. Various other known circuits may be associated with controller 46, including power supply circuitry, signal-conditioning circuitry, solenoid driver circuitry, communication circuitry, and other appropriate circuitry. It should also be appreciated that controller 46 may include one or more of an application-specific integrated circuit (ASIC), a field-programmable gate array (FPGA), a computer system, and a logic circuit, configured to allow controller 46 to function in accordance with the present disclosure. Thus, the memory of controller 46 may embody, for example, the flash memory of an ASIC, flip-flops in an FPGA, the random access memory of a computer system, or a memory circuit contained in a logic circuit. Controller 46 may be further communicatively coupled with an external computer system, instead of or in addition to including a computer system.

Controller 46 may control the movement of ripper 18 during an autodig operation. To that end, controller 46 may receive input signals from an operator of machine 10, monitor signals generated by sensors 40, 42, 44, perform one or more algorithms to determine appropriate output signals, and deliver the output signals to one or more components of machine 10 to control the angle and penetration depth of ripper 18. It is contemplated that controller 46 may move shank 26 to an angle corresponding to a configuration of shank 26, as discussed above, and/or to an operation of shank 26, such as penetrating or digging. For example, controller 46 may store a plurality of values representing the possible angle settings of shank 26 in its memory, each angle being mapped to corresponding configurations and/or operations of shank 26. Controller 46 may cause shank 26 to move to one of those angles based on the current configuration and/or operation of shank 26. More specifically, controller 46 may monitor the signal generated by sensor 44*b* for the extension of hydraulic actuator 30, convert it to the angle of shank 26 that it represents, and compare it to one of the angle values stored in the memory of controller 46. Controller 46 may then drive hydraulic actuator 30 to tilt shank 26 until the angle indicated by the signal from sensor 44*b* substantially equals the angle value stored in the memory of controller 46.

Controller 46 may set the depth of cut of shank 26 in a similar manner. More specifically, controller 46 may monitor the signal generated by sensor 44*a* for the extension of hydraulic actuator 28, convert it to the height of shank 26 that it represents, and compare it to one of the height values stored in the memory of controller 46, driving hydraulic actuator 28 until the two values are substantially equal. Controller 46 may drive hydraulic actuators 28, 30 by controlling one or more valves and/or other components of an associated hydraulic system, e.g. pumps, to selectively supply pressurized fluid to and drain the fluid from hydraulic actuators 28, 30.

Controller 46 may also control the deceleration of traction device 16. That is, controller 46 may be communicatively connected to power source 14 to affect the operation of power source 14 by reducing an amount of fuel delivered to power source 14, changing a timing of fuel injections into power source 14, and/or reducing an amount of air delivered to power source 14. It is contemplated that controller 46 may alternatively control the deceleration of traction device by directly manipulating the position of deceleration pedal 32, if desired.

Controller 46 may control the movement of shank 26 and deceleration of traction device 16 in response to a calculation of machine slip. That is, controller 46 may monitor the signals generated by sensors 40, 42, and use them to calculate a value representative of actual machine slippage. For example, in accordance with the formula disclosed above, controller 46 may calculate the actual machine slippage (i.e. slip error) $Se=1-(Sm/St)$, where Sm represents the true ground speed of machine 10, as indicated by the signal from sensor 40, and St represents the speed of traction device. 16, as indicated by the signal from sensor 42. Controller 46 may compare actual machine slippage to an upper slip threshold input by an operator of machine 10 and stored in its memory. More specifically, controller 46 may compare actual machine slippage to an acceptable slip value (i.e. the upper slip threshold input by the operator) to determine whether the actual machine slippage exceeds the acceptable slip value by a predetermined amount. The predetermined amount may be stored in the memory of controller 46. It is contemplated that the predetermined value may be 0, if desired. Controller 46 may then raise or lower shank 26, and/or affect deceleration of machine 10 until the actual slip of machine 10 is within an acceptable range of a desired slip value (i.e. Se is within an acceptable amount of a desired slip error). An exemplary operation of controller 46 will be discussed below with reference to the flowchart of FIG. 3.

INDUSTRIAL APPLICABILITY

The disclosed method and apparatus may be applicable to controlling the position and/or movement of a ripper, as well as the speed and/or torque of an associated machine, to maximize productivity. The disclosed system may maximize productivity by targeting a desired slip value through control of ripper depth and machine deceleration. An exemplary disclosed operation of control system 38, with reference to ripper 18 and traction device 16, is provided below.

Figure 3:
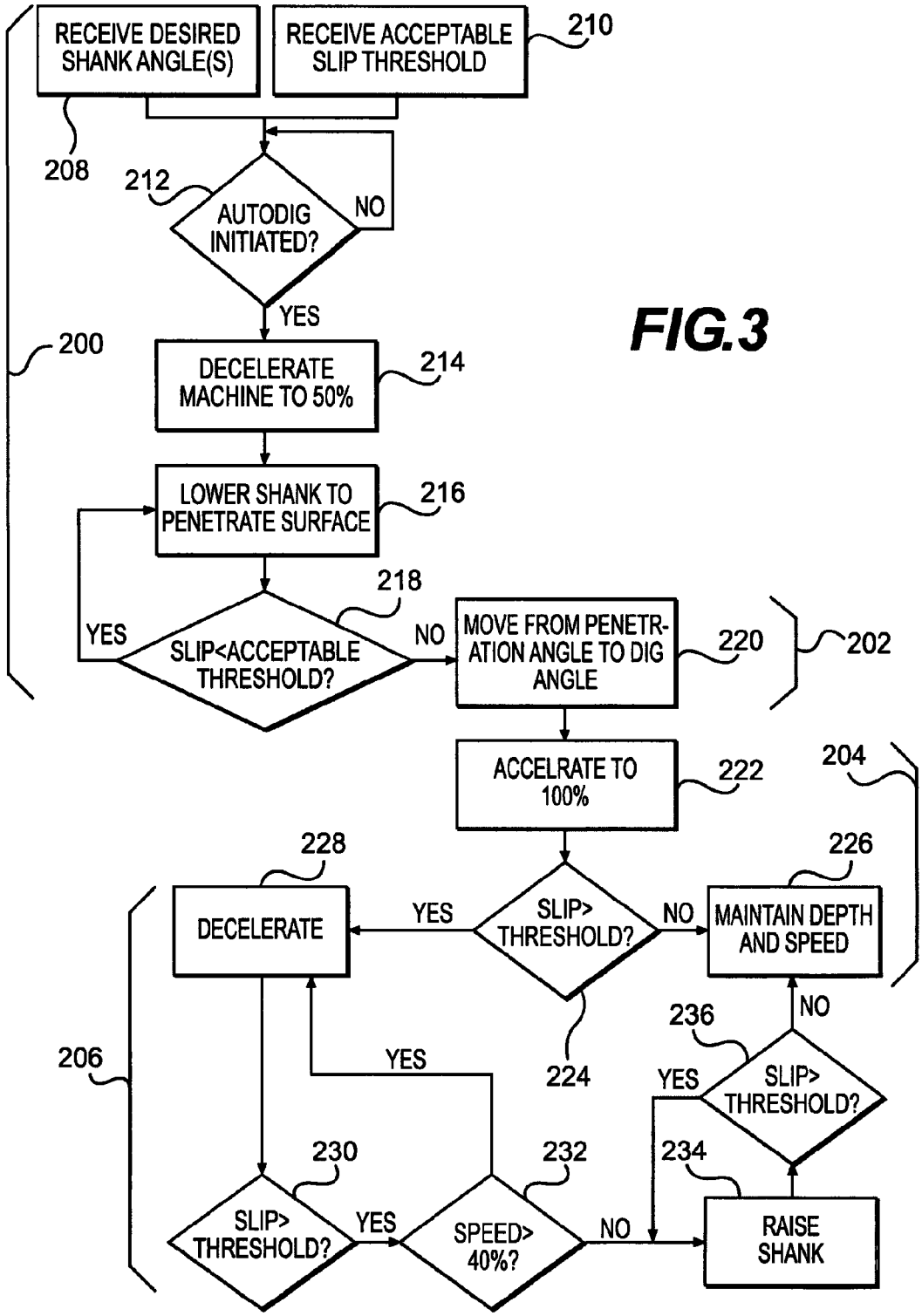
FIG. 3 is a flowchart depicting an exemplary disclosed method of operation associated with the control system of FIG. 2.

Referring to FIG. 1, shank 26 may be positioned by an operator to an angle and depth of cut below work surface 12, and traction device 16 may be operated to propel machine 10 and thus "pull" shank 26 through the material below work surface 12. The material may have varying characteristics that can affect productivity of machine 10. For example, shank 26 may transition from relatively soft or loose material to hard material and/or encounter rocks or other obstacles. As discussed above, the changing terrain may cause shank 26 to apply an increasing resistance on the movement of machine 10 that leads to machine slip. It may be difficult for the operator to adjust the acceleration of machine 10 and the position and/or angle of shank 26 to productively complete the ripping operation over the changing terrain without inducing excessive slip. FIG. 3 illustrates an exemplary autodig operation to automate the adjustments of the acceleration of machine 10 and position and/or angle of shank 26.

The autodig operation may generally include four phases. Phase 200 may include setting up and initiating the autodig operation, and lowering shank 26 into work surface 12 until a predetermined level of slip is detected. Phase 202 may include changing the angle of shank 26 relative to work surface 12 from a penetration angle to a dig angle. Phase 204 may include decelerating machine 10 to control slip. And, phase 206 may include lifting and lowering shank 26 while adjusting deceleration of machine 10 to maintain a target slip range.

Phase 200 may begin with controller 46 receiving input values as parameters to the autodig operation. For example, the operator may input a desired penetration angle parameter and a desired dig angle parameter via user interface 39 (Step 208). In another example, the operator may input a configuration of shank 26, and controller 46 may determine appropriate penetration and dig angles based on the configuration of shank 26 and the preset ripper positions stored in its memory. Controller 46 may alternatively sense a current configuration of shank 26 and determine appropriate penetration and dig angles based on the sensed configuration of shank 26. In yet another example, the operator may manipulate ripper control 34 to manually set a penetration angle of shank 26. Further, the operator may input an acceptable slip value (i.e. a parameter indicative of an acceptable level of actual machine slippage) (Step 210). Each value may be communicated to controller 46 and stored in the memory thereof after they are set and/or after the operator signals that an autodig operation should begin.

Controller 46 may then check whether an autodig operation has been initiated (Step 212). More specifically, the operator may signal that an autodig operation should begin by moving autodig switch 36 to the on position. Because autodig operation may require that machine 10 be operated in "high idle" mode, it is contemplated that the operator may also manually set machine 10 to "high idle" and engage machine 10 in forward travel before moving autodig switch 36 to the on position. It is further contemplated that controller 46 may autonomously set machine 10 to "high idle" upon determining that the operator has signaled that an autodig operation should begin. It is also contemplated that controller 46 may delay or cancel an autodig operation if the operator has not set machine 10 to "high idle."

If the operator has signaled that an autodig operation should begin, controller 46 may decelerate machine 10 from a maximum excavation speed (e.g. "high idle" speed). In one example, controller 46 may decelerate machine 10 to about 50% of the maximum excavation speed (Step 214). More specifically, controller 46 may control operation of power source 14 by reducing an amount of fuel delivered to power source 14, changing a timing of fuel injections into power source 14, and/or reducing an amount of air delivered to power source 14 to set the deceleration of machine 10 to about 50% of the maximum excavation speed. Substantially simultaneously, controller 46 may set shank 26 to the operator's desired penetration angle and lower it to penetrate work surface 12 (Step 216). That is, controller 46 may control the amount of fluid supplied to hydraulic actuator 30 to set shank 26 to the angle indicated by the penetration angle parameter stored in the memory of controller 46, and the amount of fluid supplied to hydraulic actuator 28 to lower shank 26 into the material below work surface 12 to a desired depth. It is contemplated that the operator may alternatively manually orient shank 26 to the penetration angle before beginning the autodig operation, rather than controller 46 setting the penetration angle, if desired.

Once shank 26 has penetrated work surface 12, controller 46 may monitor the signals generated by sensors 40, 42 to calculate actual slippage of machine 10. For example, controller 24 may receive the signals generated by sensors 40, 42, convert them to the speed values that they represent, and use the speed values to calculate a slip error in the manner disclosed above (e.g. according to the relation Se=1−(Sm/St) ). Controller 46 may then determine whether actual machine slippage exceeds the acceptable slip value by a predetermined amount stored in the memory of controller 46 (Step 218). If actual machine slippage is less than the acceptable slip value, controller 46 may control the amount of fluid supplied to hydraulic actuator 28 to lower shank 26 deeper into work surface 12. Controller 46 may continue to lower shank 26 deeper into work until actual machine slippage is about equal to the acceptable slip value.

Once actual machine slippage has substantially attained the acceptable slip value, controller 46 may begin Phase 202 by moving shank 26 to the desired dig angle stored in the memory of controller 46 (Step 220). More specifically, controller 46 may monitor the signal generated by sensor 44 and control the amount of fluid supplied to hydraulic actuator 30 to tilt shank 26 until the angle indicated by the signal from sensor 44 substantially equals the desired dig angle.

Controller 46 may then begin Phase 204 by reducing the deceleration (i.e. allowing acceleration) of machine 10. In one example, controller 46 may allow acceleration of machine 10 to about 100% of the maximum excavation speed (Step 222). That is, controller 46 may accelerate machine 10 by increasing an amount of fuel delivered to power source 14, changing a timing of fuel injections into power source 14, and/or increasing an amount of air delivered to power source 14 to reduce the deceleration of power source 14 (i.e. increase acceleration to about 100% of the maximum excavation speed). Controller 46 may again monitor the slip of machine 10 and compare it to the acceptable slip value, as described above (Step 224). If the actual machine slippage is less than the acceptable slip value, controller 46 may maintain the speed of machine 10 and the position of shank 26 (Step 226).

However, if the actual machine slippage is greater than the acceptable slip value by the predetermined amount stored in the memory of controller 46, controller 46 may begin Phase 206 by decelerating machine 10 and raising shank 26 until the actual machine slippage is less than the acceptable slip value. More specifically, controller 46 may decelerate machine 10, as described above, until the actual machine slippage is less than the acceptable slip value (Step 228). It is contemplated that controller 46 may additionally cease deceleration of machine 10 if the speed of machine 10 reduces to less than about 40% of the maximum excavation speed. For example, after decelerating machine 10, controller 46 may compare the actual machine slippage to the acceptable slip value (Step 230). If the actual machine slippage is still greater than the acceptable slip value, controller 46 may determine whether machine 10 is running at greater than about 40% of the maximum excavation speed (Step 232). If machine 10 is still running at greater than about 40% of the maximum excavation speed, controller 46 may repeat Steps 228-232.

However, if machine 10 is running at less than about 40% of the maximum excavation speed, controller 46 may hold excavation speed steady, control the amount of fluid supplied to hydraulic actuator 28 to raise shank 26 (Step 234), and again compare actual machine slippage to the acceptable slip value (Step 236). More specifically, controller 46 may raise shank 26 until actual machine slippage is less than the acceptable slip value. Once actual machine slippage is less than the acceptable slip value, controller 46 may maintain both the speed of machine 10 and the position of shank 26 (Step 226). It is contemplated that controller 46 may decelerate machine 10 and raise shank 26 in a different or alternating order while actual machine slippage is greater than the acceptable slip value. It is further contemplated that a lower threshold for acceptable slip of machine 10 may be desired. In this case, controller 46 may lower shank 26 and/or reduce the deceleration of machine 10 to maintain the actual machine slippage above the lower slip threshold.

The disclosed control system and method may improve machine efficiency and productivity, while reducing the effects of operator inexperience by fully automating a ripping process. In particular, because the disclosed control system and method consider and modify the depth and angles of a ripping tool, as well as the speed of the machine, productivity of the machine may be optimized over a changing terrain. In addition, because the disclosed control system and method may be fully automated, the level of experience of a machine operator may have little or no impact on the productivity of the ripping process. Thus, productivity of the machine the may be optimized regardless of the operator.

Further, because the disclosed control system and method may be fully automated, it may be applicable to any ripper configuration. That is, by storing preset ripper positions and/or orientations for each configuration of the ripper, the control system may allow a ripper to optimally penetrate and dig below a work surface, regardless of its configuration.

It will be apparent to those skilled in the art that various modifications and variations can be made to the disclosed system for controlling implement position and machine speed. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A control system for a machine having a power source, a traction device, and a ripping tool, comprising:

a slip sensor configured to generate at least one signal indicative of machine slippage;

at least one actuator operable to move the ripping tool; and a controller in communication with the slip sensor, the at least one actuator, and the power source, the controller being configured to:

receive at least one operator input indicative of an acceptable slip value;

determine an actual machine slippage based on the at least one signal;

directly and separately regulate a fueling of the power source and a movement of the ripping tool during an excavation process based on the acceptable slip value and the actual machine slippage, including lowering the ripping tool into a work surface until the actual machine slippage is within a desired value;

reduce fueling to decrease a machine travel speed in response to the actual machine slippage exceeding the acceptable slip value; and raise the ripping tool away from the work surface in response to machine slippage only if progressive reduction of the fueling decreases the machine travel speed to a reference value without reducing the actual machine slippage below the acceptable slip value.

2. The control system of claim 1, wherein the slip sensor includes a travel speed sensor and a traction device speed sensor, the actual machine slippage being determined based on a difference between a travel speed of the machine and a speed of the traction device.

3. The control system of claim 1, wherein:

the controller regulates a movement of the ripping tool by activating the at least one actuator; and regulating a movement of the ripping tool includes regulating both a height and an angle of the ripping tool.

4. The control system of claim 3, wherein the ripping tool has a plurality of available settings and the controller is further configured to regulate the angle of the ripping tool based on a current one of the plurality of settings.

5. The control system of claim 4, wherein the controller is further configured to detect the current one of the plurality of settings.

6. The control system of claim 4, wherein the controller is configured to regulate the angle of the ripping tool based further on a task currently being performed by the machine.

7. The control system of claim 1, wherein the controller is further configured to decelerate travel of the machine to a first speed before lowering the ripping tool into the work surface.

8. The control system of claim 7, wherein the controller is further configured to accelerate the machine to a second speed after the ripping tool is lowered into the work surface.

9. The control system of claim 8, wherein the controller accelerates the machine to the second speed after activating the actuator to move the ripping tool from a penetration angle to a ripping angle while the ripping tool is lowered in the work surface.

10. The control system of claim 9, wherein reducing fueling to decrease a machine travel speed in response to the actual machine slippage exceeding the acceptable slip value includes doing so after movement of the ripping tool to the ripping angle and after the acceleration of machine travel speed to the second speed, if the actual machine slippage exceeds the acceptable slip value by a predetermined amount.

11. The control system of claim 10, wherein reducing fueling to decrease a machine travel speed in response to the actual machine slippage exceeding the acceptable slip value includes continuing decelerating the travel speed of the machine to a limit of about 40% of the second speed when the actual machine slippage exceeds the acceptable slip value by the predetermined amount.

12. The control system of claim 11, wherein raising the ripping tool away from the work surface in response to machine slippage only if progressive reduction of the fueling decreases the machine travel speed to a reference value without reducing the actual machine slippage below the acceptable slip value includes raising the ripping tool away from the work surface after the travel speed of the machine has been decelerated to about 40% of the second speed if the actual machine slippage still exceeds the acceptable slip value by the predetermined amount.

13. A method of autonomously controlling a ripping tool of a mobile machine, comprising:

receiving a threshold machine slip value;

adjusting a current travel speed to a first threshold speed less than a maximum excavation travel speed;

determining a first actual machine slippage;

lowering the ripping tool into a work surface while determining the first actual machine slippage until the first actual machine slippage is within a desired value;

adjusting an angle of the ripping tool after the ripping tool has been lowered into the work surface;

increasing the current travel speed after the angle of the ripping tool has been adjusted;

determining a second actual machine slippage after increasing the current travel speed;

reducing the current travel speed while determining the second actual machine slippage until the second actual machine slippage is within a desired amount of the threshold machine slip value or until the current travel speed is within a desired amount of a second threshold speed greater than a minimum excavation travel speed; and raising the ripping tool away from the work surface in response to machine slippage only if the second actual machine slippage still exceeds the threshold slip value after the current travel speed has been reduced to the second threshold speed.

14. The method of claim 13, wherein adjusting the angle of the ripping tool includes moving a tip of the ripping tool toward the machine.

15. The method of claim 14, further including regulating the angle of the ripping tool based on at least one of a ripping tool configuration and a task currently being performed by the ripping tool.

16. The method of claim 13, wherein the first threshold speed is about 50% of a maximum excavation travel speed.

17. The method of claim 16, wherein the travel speed is adjusted by changing a fueling of an engine.

18. The method of claim 14, further including determining a configuration of the ripping tool, and limiting the angle of the ripping tool based on the configuration such that the tip of the ripping tool is kept from a location under the mobile machine.

19. The method of claim 13, wherein the second threshold speed is about 80% of the first threshold speed.

20. A machine, comprising:

a power source configured to generate a power output;

a traction device driven by the power output to propel the machine;

a ripping tool movable to disrupt a work surface;

an actuator coupled to move the ripping tool;

a travel speed sensor configured to generate a first signal indicative of a machine travel speed;

a traction device speed sensor configured to generate a second signal indicative of a traction device speed; and a controller in communication with the power source, the actuator, the travel speed sensor, and the traction device speed sensor, the controller being configured to:

receive at least one operator input indicative of a threshold slip value;

determine an actual machine slippage based on the first and second signals; and directly and separately regulate a fueling of the power source and a movement of the ripping tool during an excavation process based on the threshold slip value and the actual machine slippage, including raising the ripping tool away from the work surface in response to slippage only if the actual machine slippage exceeds the threshold slip value by the predetermined amount after reduction of the fueling of the power source to decrease the machine travel speed to a reference value.

21. The machine of claim 20, wherein the controller is further configured to:

decelerate current travel speed of the machine to about 50% of a maximum excavation travel speed;

lower the ripping tool into a work surface after decelerating the current travel speed of the machine and while determining the actual machine slippage until the actual machine slippage is about equal to the threshold slip value;

adjust an angle of the ripping tool after the ripping tool has been lowered into the work surface;

return the current travel speed of the machine to the maximum excavation travel speed after the angle of the ripping tool has been adjusted; and adjust the machine travel speed and the movement of the ripping tool, if the actual machine slippage deviates from the threshold slip value after return of the machine to the maximum excavation speed.

22. The control system of claim 21, wherein the threshold slip value defines a range having an upper slip threshold and a lower slip threshold.

* * * * *